US008453573B1

(12) United States Patent
McKimm et al.

(10) Patent No.: US 8,453,573 B1
(45) Date of Patent: Jun. 4, 2013

(54) PRIMER ADAPTER FOR HAND GRENADE FUZE

(75) Inventors: Thomas McKimm, Mount Freedom, NJ (US); Amy Mulvoy, Lafayette, NJ (US); Nicole Sapp, Newton, NJ (US); Anthony DiGiacomo, Wayne, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 3 days.

(21) Appl. No.: 13/160,780

(22) Filed: Jun. 15, 2011

(51) Int. Cl.
*F42B 27/00* (2006.01)

(52) U.S. Cl.
USPC ..... 102/487; 102/488

(58) Field of Classification Search
USPC ..... 102/487, 334, 368, 482, 488
See application file for complete search history.

(56) References Cited

U.S. PATENT DOCUMENTS

| | | | | | |
|---|---|---|---|---|---|
| 3,442,474 | A * | 5/1969 | Foster et al. | ..... | 244/147 |
| 3,795,197 | A * | 3/1974 | Levenson | ..... | 102/368 |
| 4,383,470 | A * | 5/1983 | Assmann | ..... | 86/20.1 |
| 4,730,559 | A * | 3/1988 | Brightman | ..... | 102/254 |
| 4,926,752 | A * | 5/1990 | DiRubbio et al. | ..... | 102/486 |
| 4,976,201 | A * | 12/1990 | Hamilton | ..... | 102/323 |
| 5,196,649 | A * | 3/1993 | DiRubbio et al. | ..... | 102/486 |
| 6,578,489 | B2 * | 6/2003 | Boyer et al. | ..... | 102/272 |
| 6,640,719 | B1 * | 11/2003 | Pacella et al. | ..... | 102/277.1 |
| 7,387,073 | B2 * | 6/2008 | Bodley et al. | ..... | 102/498 |
| 2011/0226492 | A1 * | 9/2011 | Tagliareni et al. | ..... | 169/9 |

* cited by examiner

*Primary Examiner* — James Bergin
(74) *Attorney, Agent, or Firm* — Michael C. Sachs

(57) ABSTRACT

A primer adapter allows hand grenade fuzes of different configurations to use the same primer for the ignition of their explosive trains.

1 Claim, 4 Drawing Sheets

PRIMER ADAPTER FOR HAND GRENADE FUZE

UNITED STATES GOVERNMENT INTEREST

The inventions described herein may be manufactured, used and licensed by or for the U.S. Government for U.S. Government purposes.

FIELD OF THE DISCLOSURE

This disclosure relates to hand grenades. More particularly, this disclosure relates to primers used in hand grenade fuzes.

BACKGROUND OF THE DISCLOSURE

Hand grenades are small explosive, incendiary, or smoke producing devices thrown by military or law enforcement personnel in the course of military or law enforcement operations. Hand grenades typically have a body that contains an explosive or chemical filler and a fuze that ignites or detonates the filler in the grenade. The fuze contains a powder train that provides a time delay between the arming of the grenade by a soldier or policeman and the actual detonation of the grenade. The fuze is lit by the action of a spring loaded striker mechanism impacting a primer which ignites a delay element that burns for a predetermined time and then detonates the filler. The grenade is prevented from being armed by a safety handle that blocks the striker mechanism from impacting the primer from a primer. A safety pin locks the safety handle to prevent the arming of the grenade. When the safety pin is withdrawn, the safety lever is free to release from the body of the grenade. When the safety lever is released, the striker spring unwinds and the striker rotates on axis to impact the primer, which then creates a flash of heat that ignites one end of the delay element. The delay element burns down to an igniter at the other end of delay element, which then sets off the main charge or filler of the grenade.

The M201A1 hand grenade fuze had been in use since World War II, mainly in smoke grenades and the like. Variations of the M201A1 fuze are also used in smoke pots, less than lethal grenades and some lethal grenades. The M201A1 fuze is a pyrotechnic delay igniting fuze. The fuze is equipped with a steel safety pin and pull ring. To arm the grenade, the safety pin is removed while holding the lever tight to the grenade body. When the lever is released, a spring-loaded striker rotates and impacts a primer. The impact with the primer ignites a delay element, which initiates the igniter. The igniter then activates a smoke mix in the grenade achieving the desired signal and/or screening effect.

SUMMARY OF THE DISCLOSURE

In the recent past, various different configurations of this fuze have been developed. It would be desirable, however, to standardize the parts used in as many grenades as possible, and the U.S. Army has recently started a program to standardize grenade fuzes as much as possible. One of the components that is desirable to standardize is the primer. The M201A1 normally uses an M39A1 primer which in the last several years has caused some failures during production. It would be desirable to replace the unreliable M39A1 primer with the M42 primer which is currently being used on the M228 and M213 fuzes. This primer is less expensive than the M39A1, and the M42 primer has a better history of reliability based on production testing. The M42 primer, however, does not fit the M201A1 fuze. To use the M42 primer in the M201A1 fuze, an adapter disclosed herein was designed to hold the primer securely in the M201A1 fuze by making its diameter fit the size of the M201A1 cartridge. The primer adapter allows the use of the M42 primer with no changes to the current hardware configuration of the M201A1 fuze. It also gives the M201A1 increased reliability compared to the current configuration with the M39A1 primer. The primer adapter also supports commonality among the active hand grenade fuzes such as the M201A1, M213, and M228, by allowing all active hand grenade fuzes to use the same primer for the ignition of their explosive trains.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

Figure 1B:
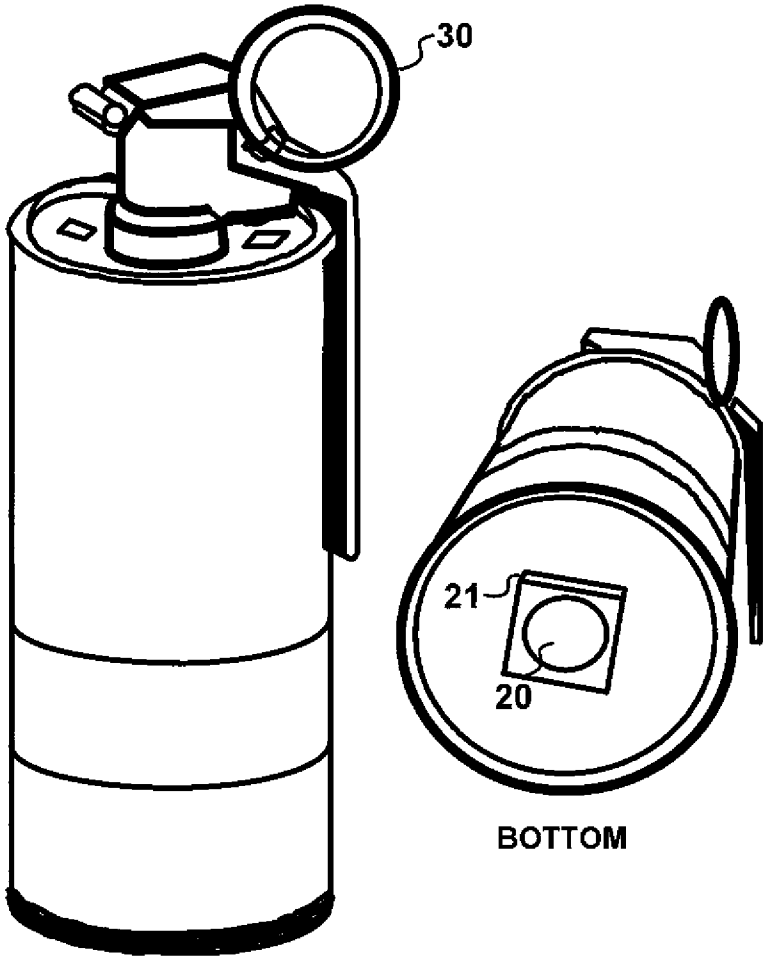
FIG. 1*b* is a bottom view of the grenade of FIG. 1*a*.
Figure 1A:
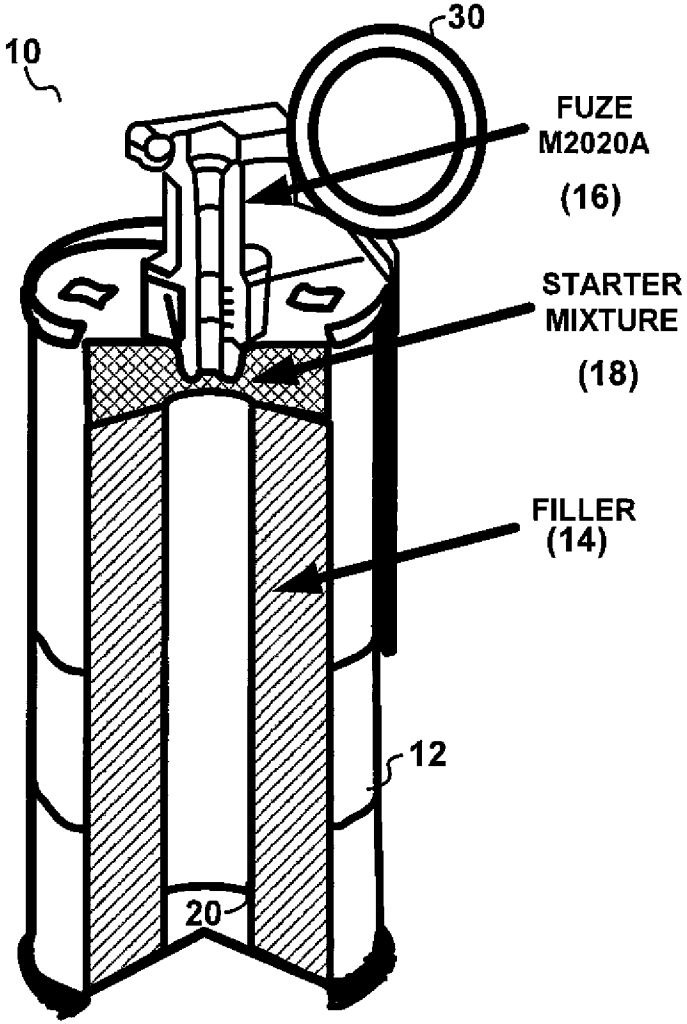
FIG. 1*a* is a partially cut away view of an illustrative hand grenade in accordance with the invention.

FIGS. 1*a* and 1*b* illustratively show the US Military's M18 colored smoke grenade 10 used for training and combat situations that uses an M201A1 fuze. The fuze in the grenade 10 advantageously may use a primer adapter in accordance with this invention that would permit the use of a primer that is not normally sized for incorporation into the structure of the M18 grenade. The primer adapter in accordance with this invention reduces costs, enhances reliability, and standardizes the parts used in a wide variety of grenade types.

Figure 2B:
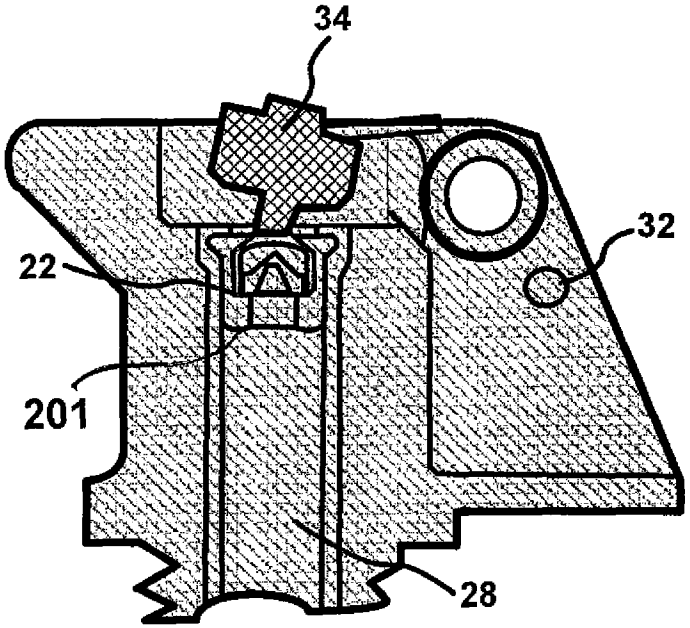
FIG. 2b PRIOR ART
FIG. 2*b* is a sectional view of the grenade fuze of FIG. 2*a* after actuation.
Figure 2A:
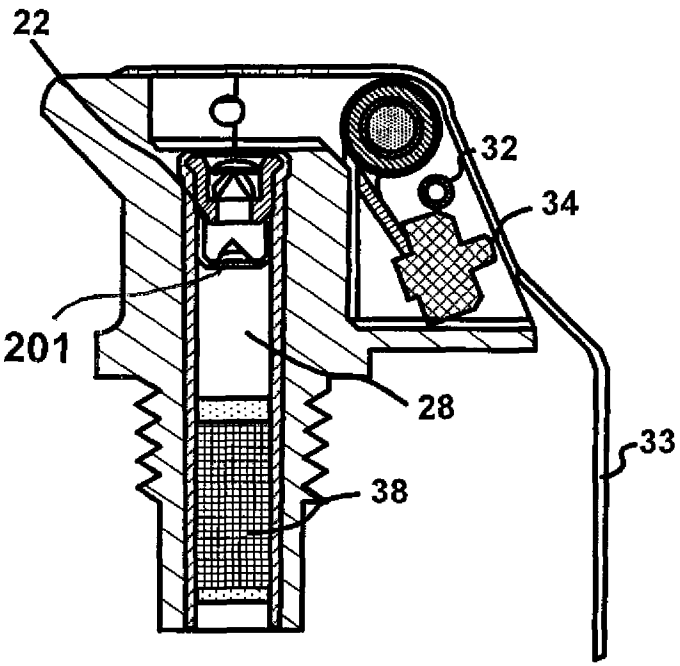
FIG. 2a PRIOR ART
FIG. 2*a* is a sectional view of an illustrative grenade fuze in accordance with the prior art in an unactuated state.
Figure 3B:
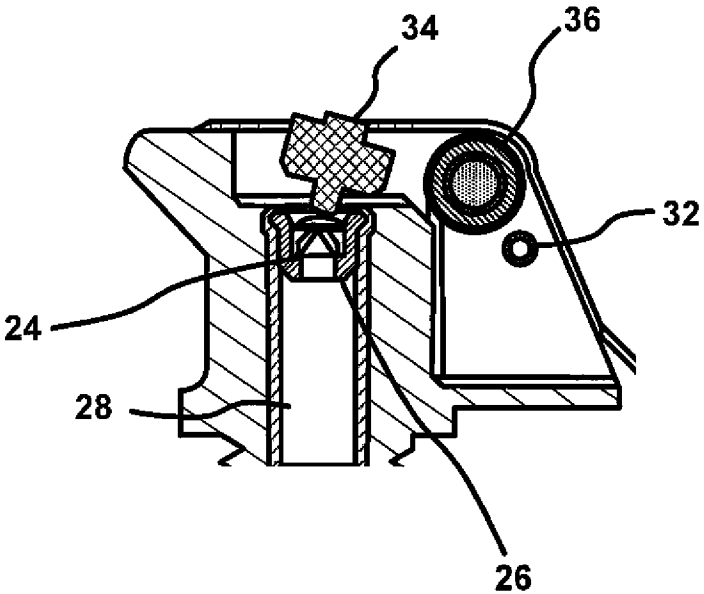
FIG. 3*b* is a sectional view of the grenade fuze of FIG. 3*a* after actuation.
Figure 3A:
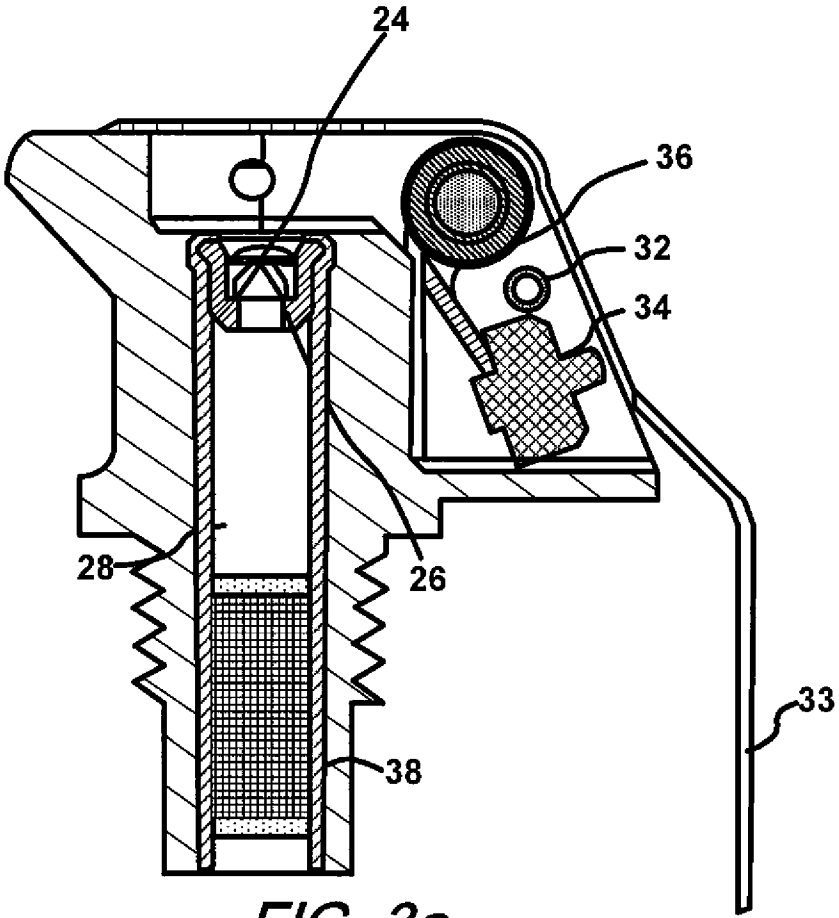
FIG. 3*a* is sectional view of an illustrative grenade fuze in accordance with this invention in an unactuated state.
Figure 4B:
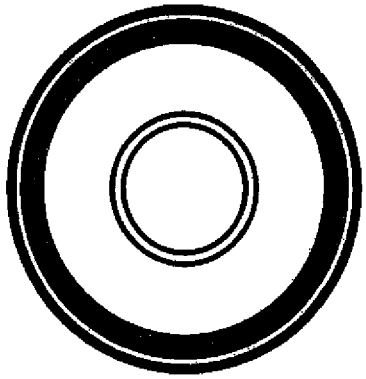
FIG. 4*b* is a top view of the primer adapter of FIG. 4*a*.
Figure 4A:
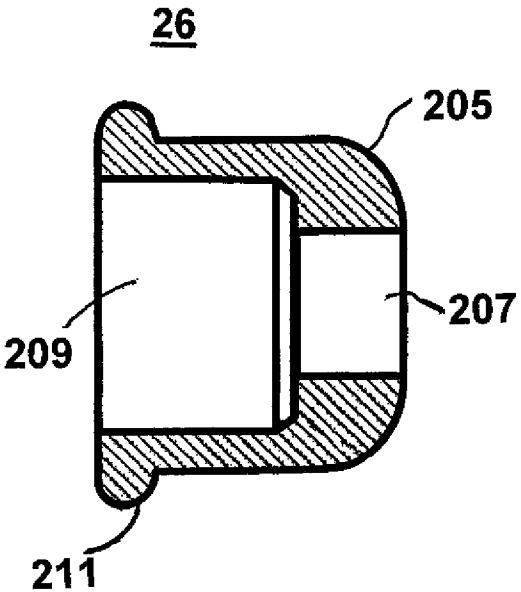
FIG. 4*a* is a side sectional view of a primer adapter in accordance with the invention.

FIGS. 2*a* and 2*b* show a conventional M201A1 fuze in the unactuated and actuated states, respectively. The fuze of FIGS. 2*a* and 2*b*, (PRIOR ART), uses a conventional M39A1 primer that has been found to be unreliable. Its existing primer 22 is shown here as being fully encased in a unit 201 which fits snugly into this fuze. FIGS. 3*a* and 3*b* show an M201A1 fuze in accordance with this invention in the unactuated and actuated states, respectively. The fuze of FIGS. 3*a* and 3*b* uses an M42 primer (24) that has been found to be more reliable and less expensive. FIGS. 4*a* and 4*b* show various views of an adapter 26 to be now used in this a grenade fuze in accordance with the invention.

The grenade 10 shown in FIGS. 1*a* and 1*b* comprises a cylindrical body 12 made of sheet steel and containing a chemical filler material 14 that produces colored smoke when it is ignited by the operation of an M201A1 igniting fuze 16 screwed into an opening in the top of the grenade body 12. The fuze 16 ignites a chemical starter material 18 that fills the top of the grenade body 12, which in turn ignites the filler material 14 in the main compartment of the body 12. Ignition of the filler material 14 produces an expanding cloud of colored smoke which is expelled from the grenade 10 through a normally taped opening 20 in the bottom of the body 12, and shown most clearly in FIG. 1*b*.

Igniting fuzes like the M201A1 fuze 16 in FIGS. 1*a* and 1*b* are pyrotechnic delay-igniting fuzes designed for use with a variety of chemical hand grenades. They burn at high temperatures to ignite a chemical filler in the grenade. In addition to the M18 smoke grenades, the M201A1 fuze 16 is also designed for use with the AN-M83HC white smoke grenade and the AN-M14 TH3 incendiary grenade.

The fuze 16 provides a time delay between the actuation of the grenade and the ignition of the filler material 14. In one illustrative embodiment, the time delay element is a powder train requiring 1.2 to 2 seconds to burn to the starting mixture. In all cases, the starting mixture ignites the explosive or pyrotechnic and expels the desired output from the grenade body.

FIGS. 2*a* and 2*b* are detail drawings of the M201A1 fuze 16 shown in FIG. 1*a*. The fuze 16 of FIGS. 2*a* and 2*b* uses an M39A1 primer 22 that is more expensive and less reliable than an M42 primer. FIGS. 3*a* and 3*b* are detail drawings of the M201A1 fuze using an M42 primer 24 adapted for use in an M201A1 fuze. Normally, an M42 primer does not fit securely in the cartridge of an M201A1 fuze 16. The fuze 16 in FIG. 2*b* incorporates an adapter 26 that allows the M42 primer to fit securely in the cartridge 28 of the M201A1 fuze 16. The adapter 26 is shown in FIGS. 4*a* and 4*b*. Adapter 26 has a first end 205 which identically matches the size and shape of unit 201 and which will now be fit snugly into this M201A1 fuze, and it also has a lip 211 on the adapter's opposite end to aid in so fitting in 26 into the fuze, and holding 26 in place. Adapter 26 also has a counter-sunk annular cavity 209 in its said opposite end to receive new primer 24 (the M42), and which cavity identically mates to primer 24 both in size and in shape, so as to completely receive such primer 24. Adapter 26 also has a lower opening hole 207 in the adapter's first end and reaching all the way to said cavity 209 so as to allow a flash from primer 24 to be able to travel further on below into the remainder of the M201A1 fuze.

The grenade 10, in the example of the invention depicted in FIGS. 1*a* and 1*b*, is a burning-type smoke grenade fitted with an M201A1 igniting fuze 16 which functions with a 1.2 to 2-second delay. Functioning of the fuze 16 ignites a starting mixture 18, which ignites the filler 14.

The burning of the filler 14 creates sufficient pressure to blow out a tape 21 that normally covers one or more emission holes or gas ports 20 in the body of the grenade. Blow out of the tape 21 over the emission hole 20 allows a chemical agent, such as riot control gas or smoke, produced by the combustion of the filler material 14 in the grenade, to escape from the body 12 of the grenade 10 through the emission hole 20.

The fuze 16 in the grenade 10 includes a pull ring and safety pin 30 inserted through a hole 32. The safety pin 30 in the hole 32 holds a safety lever 33 against the side of the grenade body 12. The safety lever 33 in position against the body 12 of the grenade 10 holds a striker 34 away from a primer 24 against the force of a striker spring 36 that urges the striker 34 towards the primer 24.

Removal of the safety pin 30 permits release of the safety lever 33, which then has to be held against the body 12 of the grenade 10 to prevent detonation. Once the grenade 10 is thrown, the pressure on the safety lever 33 is released, and the striker 34 is forced to rotate on its axis by the striker spring 36, throwing off the safety lever 33. The striker 34 then impacts the primer 24 with a force that detonates the primer 24, which then explodes and ignites one end of a delay element 38. The delay element 38 burns for the prescribed amount of time and then activates the starter mixture 18. The activation of the starter mixture 18 acts to either explode or burn the filler substance 14.

At this point, while we have discussed and described the invention using some specific examples, those skilled in the art will recognize that our teachings are not so limited. For example, the fuze adapters may be used with pyrotechnic and/or explosive devices which are modified variants of those explicitly disclosed herein. Accordingly, the invention should be only limited by the scope of the claims attached hereto.

The invention claimed is:

1. A hand grenade, comprising:

a body containing a filler substance; and an M201A1 fuze assembly attached to the body and adapted to ignite the filler substance in the body, the fuze assembly comprising an M42 primer and an adapter that permits the M42 primer to be fitted to the M201A1 fuze assembly, said adapter comprising a cylindrical metal body one first end of which is sized to fit securely into a primer holder cavity in said M201A1 fuze assembly, said adapter also having a counter-sunk annular cavity in its opposite end, said counter-sunk annular cavity sized to securely receive an M42 size primer therein, and said adapter first end also having an annular hole therein which reaches completely into the said counter-sunk annular cavity, said annular hole enabling a flash from said M42 primer to travel through said adapter, further along into said M201A1 fuze assembly, and wherein said adapter further has lips at the said opposite end to assure said M201A1 fuze assembly will securely contain said adapter when inserted thereinto.

* * * * *